US009392862B1

(12) United States Patent
Hajianpour

(10) Patent No.: US 9,392,862 B1
(45) Date of Patent: Jul. 19, 2016

(54) BOTTLE AND CLIP ATTACHABLE TO A WAISTBAND

(75) Inventor: Zoya Hajianpour, Fort Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 1737 days.

(21) Appl. No.: 12/072,820

(22) Filed: Feb. 28, 2008

Related U.S. Application Data

(63) Continuation-in-part of application No. 10/634,491, filed on Aug. 5, 2003, now abandoned.

(60) Provisional application No. 61/009,891, filed on Jan. 3, 2008.

(51) Int. Cl.
*A45F 5/00* (2006.01)
*B65D 23/00* (2006.01)
*A45F 5/02* (2006.01)

(52) U.S. Cl.
CPC ..... *A45F 5/021* (2013.01); *B65D 23/001* (2013.01)

(58) Field of Classification Search
USPC ..... 224/148.1, 148.4, 148.7, 666, 668, 269, 224/255, 414; 24/3.12
See application file for complete search history.

(56) References Cited

U.S. PATENT DOCUMENTS

| | | | | |
|---|---|---|---|---|
| 2,658,297 | A | 11/1953 | Woolsey | |
| 3,768,684 | A * | 10/1973 | Buchtel | 215/399 |
| 4,101,043 | A * | 7/1978 | Johnson et al. | 215/399 |
| 4,345,704 | A * | 8/1982 | Boughton | 224/414 |
| 4,836,416 | A * | 6/1989 | Shalgi et al. | 222/48 |
| 5,251,777 | A * | 10/1993 | McMahon | 220/480 |
| 5,261,122 | A * | 11/1993 | Otsuki et al. | 455/351 |
| 5,331,721 | A | 7/1994 | Raum, Sr. | |
| 5,381,922 | A | 1/1995 | Gladman et al. | |
| 5,484,128 | A * | 1/1996 | Franco, Sr. | 248/311.2 |
| 5,664,292 | A * | 9/1997 | Chen | 24/3.11 |
| 5,748,454 | A * | 5/1998 | Nichols et al. | 361/814 |
| 5,927,579 | A * | 7/1999 | Schwabe | 224/269 |
| D433,729 | S * | 11/2000 | Poirier et al. | D7/511 |
| 6,441,872 | B1 * | 8/2002 | Ho | 348/837 |
| 6,502,283 | B1 * | 1/2003 | Aguirre | 24/3.11 |
| 6,688,505 | B1 | 2/2004 | Bradley et al. | |
| D539,150 | S * | 3/2007 | Leoncavallo et al. | D9/522 |

* cited by examiner

*Primary Examiner* — Justin Larson
(74) *Attorney, Agent, or Firm* — Ronald V. Davidge

(57) ABSTRACT

A bottle includes a track extending along a rear surface for the attachment of a clip to hold the bottle to a waistband, with the clip being attached to the bottle as the clip is moved upward along the bottle and released from the bottle as the clip is moved downward along the bottle. Preferably, the clip additionally includes a concave cylindrical surface for adhesive attachment to another type of bottle.

6 Claims, 5 Drawing Sheets

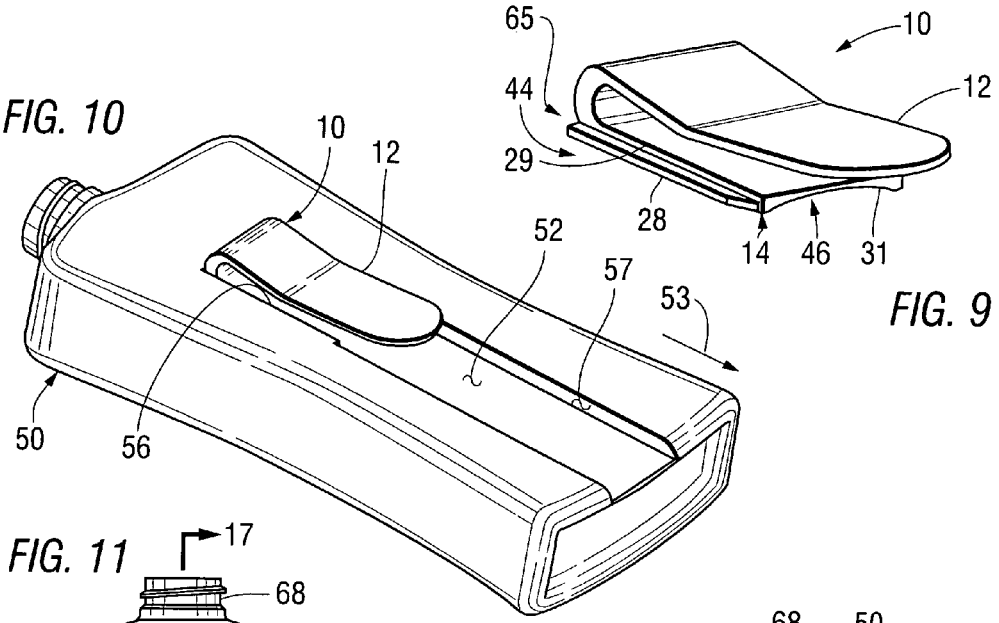
FIG. 10
FIG. 9
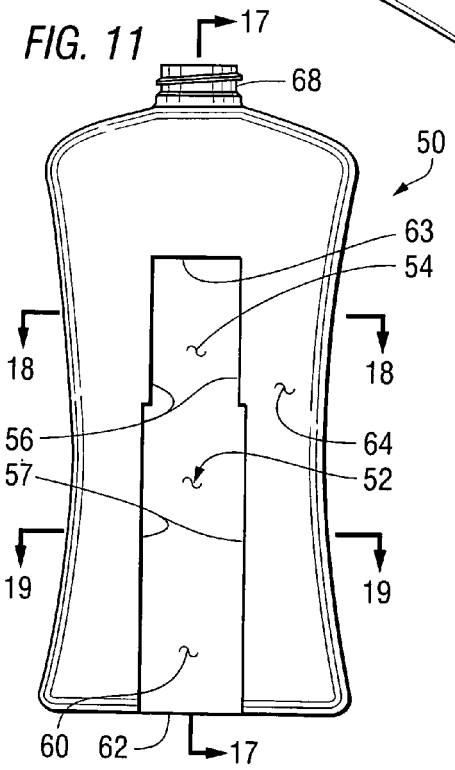
FIG. 11
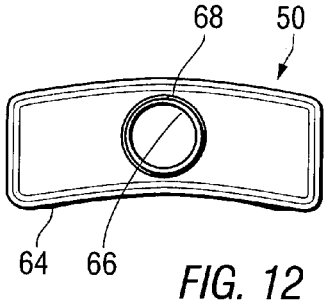
FIG. 12
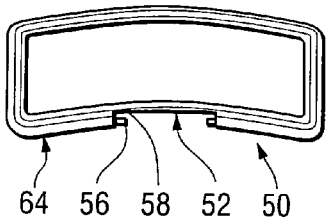
FIG. 13

50

50

BOTTLE AND CLIP ATTACHABLE TO A WAISTBAND

CROSS-REFERENCE TO RELATED APPLICATIONS

This application is a continuation-in-part of U.S. patent application Ser. No. 10/634,491, filed Aug. 5, 2003, now abandoned. This application also claims the benefit of U.S. Provisional Application No. 61/009,891 filed Jan. 3, 2008.

STATEMENT REGARDING FEDERALLY SPONSORED RESEARCH OR DEVELOPMENT

Not Applicable

BACKGROUND OF THE INVENTION

1. Field of the Invention

This invention relates to a bottle and clip attachable to a belt or waistband of clothing and, more particularly, to a such a bottle having a track for removable attachment of the clip, with the clip being additionally adhesively attached to a bottle not having such a track.

2. Summary of the Background Art

Many people prefer to drink certain types of bottled water or other drinks to an extent sufficient to justify carrying a personal supply of such liquids with them. While such liquids are readily available in grocery and convenience stores in small bottles suitable for individual consumption, a particular problem arises during walking, jogging, or while performing other moving exercises in that it is inconvenient to a bottle of liquid in one's hand. While such exercises tend to stimulate thirst, they also often carry the individual into locations where bottles of the desired liquids are not available. Thus, what is needed is a convenient method for attaching such a bottle to one's clothing so that it can be carried while the hands are left free.

U.S. Pat. Nos. 5,331,721 and 6,168,057 each describe a U-shaped clip that can be applied to an object to facilitate holding the object by means of the clip on one's belt, waistband, or on another supporting edge of ones clothing, such as a pocket. Each of these clips has an inner leg to extend downward inside the belt or clothing and an outer leg, also extending downward from the top of the clip, with an outer surface having means for attachment to the object to be held. In the device of U.S. Pat. No. 5,331,721, the outer surface of the outer leg has a rectangular adhesive pad and a removable protective liner, so that the object to be held is securely clip. In the device of U.S. Pat. No. 6,168,057, the outer surface of the outer leg has the first strip of a pair of removably attachable fastening strips. The second strip is provided with an adhesive backing and a release layer, so that the object to be held is releasably attached to the clip. In the device of each of these patents, the outer surface of the outer leg is flat, so that the clip can only be attached to an object having a flat side, such as a walkie-talkie, a cordless telephone, or a single-use camera. What is needed is a clip having a curved outer surface with an adhesive layer for the attachment of a generally cylindrical object, such as a water bottle.

U.S. Pat. No. 4,955,572 describes a supporting device for sports bottles having a liquid container with an integral neck and a cap that fits on the neck to hold the sports bottle in a vertical position. The supporting device is an integrally formed manufacture having a retaining section with a hole to fit over the neck of the container and is secured against vertical movement when the sports bottle cap is screwed down.

Integral with the supporting device is a mounting tab which extends downward toward the container's base at or near the side of the sports bottle container when the supporting device is secured on the sports bottle. The bottle can now be hung by placing the mounting tab over one's belt to free his hands while he is walking. Additionally, by adhering a receiving block, having a hole that accepts the mounting tab, in a convenient location within a car a sports bottle can be hung within a car within easy reach of the user This device relies on the wide mouth of the bottle to hold the supporting device in place on the bottle and on the use of a straw to drink from the bottle, eliminating a need to unscrew the cap, which would loosen the attachment of the supporting device to the bottle. Thus, what is needed is a supporting device that can be used with many types of bottles, including the small bottles, without wide necks, in which spring water is often sold.

U.S. Pat. Nos. 5,325,991 and 5,381,932 each describe a holder including a hollow cylinder, open at the top, for holding a cylindrical object, such as a bottle, cup, or can, and additionally including an attachment member having an inner leg that can extend downward inside a belt or waistband and an outer leg removably attached to the hollow cylinder by a two-part fastener, such as a VELCRO fastener. What is needed is a low-cost clip that can be attached to a disposable bottle and disposed with the bottle, eliminating a need to return with a large empty holder.

Other patents describe specialized containers into which a fluid is poured before it is consumed. For example, U.S. Pat. No. 5,988,464 describes a wide-mouth drink bottle having one strip of a two-part fastener extending along one side of the bottle. The mating part of the two-part fastener extends along the side of a vertical strap having a pair of loops through which the user's belt is placed. U.S. Pat. No. 5,984,145 describes a body-mounted water dispensing system for providing a convenient method of drinking liquids while exercising. The system includes a water container and pump, mounted on a belt, together with an outlet hose and drinking tube extending upward to the wearer's mouth. Again, what is needed is a low-cost disposable system. U.S. Pat. Nos. 5,743,620 and 6,260,731 each describe a specialized bottle including a clip allowing the bottle to be attached to clothing. What is needed is a system allowing the use of readily available disposable bottles, without requiring the fluid to be poured into another container before it is consumed, and similarly eliminating a need to wash the container after use.

SUMMARY OF THE INVENTION

In accordance with a first aspect of the invention, a bottle and a clip are provided. The bottle includes a rear surface and a track extending along the rear surface, having a downwardly directed stopping surface. The clip includes an upper portion, an upwardly directed stopping surface, an inner leg and an outer leg, each extending downward from the upper portion, and a first mounting structure. The first mounting structure engages the track of the bottle as the clip is moved upward along the bottle with the first mounting structure within the track to hold the clip in place within the track. When the clip is held in place within the track, the inner leg extends downward, being spaced apart from the bottle, and further movement of the clip within the track is prevented by contact between the upwardly directed stopping surface of the clip and the downwardly directed stopping surface of the track.

As the terms are used herein, the upward direction is established for both the bottle and the clip as the direction facing upward when the bottle is attached to the belt or waistband of a standing person, with the inner leg of the clip being the leg extending inside the belt or waistband.

For example, the first mounting surface includes a ridge extending outward from each side of the clip, while the track includes a ridge extending inward from each side of the track to form adjacent slots into which the ridges of the first mounting surface are moved to hold the clip in place within the track.

Preferably, the clip additionally includes a second mounting surface, for adhesively attaching a bottle not including the track. For example, the second mounting surface includes a concave cylindrical surface forming a portion of an outer surface of the outer leg of the clip.

BRIEF DESCRIPTION OF THE DRAWINGS

FIG. 9 is a perspective view of the clip of FIG. 1;

FIG. 10 is a perspective view of a bottle built in accordance with a second embodiment of the invention attached to the clip of FIG. 1;

FIG. 11 rear view of the bottle of FIG. 10;

FIG. 12 is a plan view of the bottle of FIG. 10;

FIG. 13 is a bottom plan view of the bottle of FIG. 10;

DETAILED DESCRIPTION OF THE INVENTION

Figure 1:
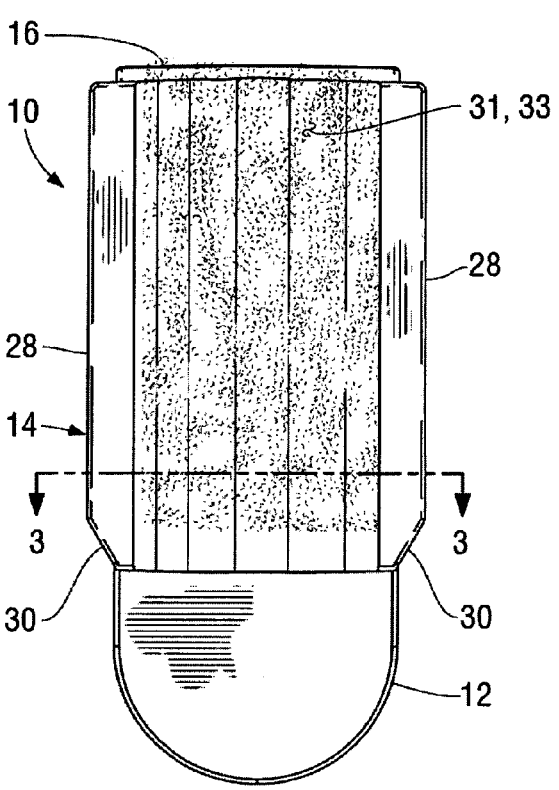
FIG. 1 is a front elevation of a clip made in accordance with an embodiment of the invention.
Figure 2:
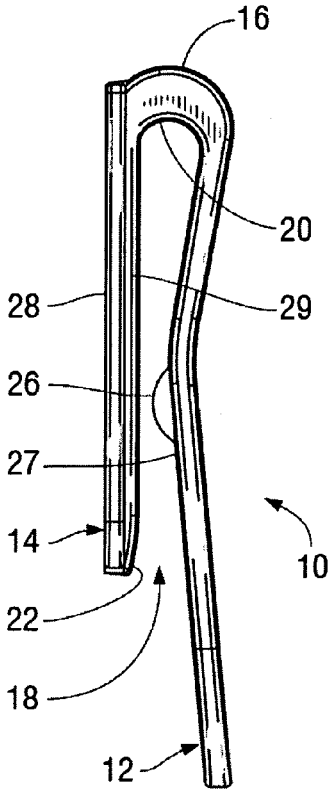
FIG. 2 is a right elevation of the clip of FIG. 1.

According to a first embodiment of the invention, a clip 10 is provided with a concave, adhesive coated surface for additionally with a pair of spaced-apart ridges for removable engagement with a track within a surface of a bottle configured for engagement with the ridges. FIGS. 1-6 are views of the clip 10, with FIG. 1 being a front view, FIG. 2 being a right elevation, FIG. 3 being a longitudinal cross-sectional elevation, FIG. 4 being a plan view, FIG. 5 being a bottom plan view, and FIG. 6 being a rear view. The clip 10 is generally shaped as an inverted "U," having an inner leg 12 and an outer leg 14, both of which extend downward from a curved connecting portion 16. The clip 10 is configured to be worn over the waistband of a garment, such as pants or a skirt, with the inner leg 12 extending downward, in the direction of arrow 13, within the garment, and with the outer leg 14 extending downward outside the garment. In this way, both the waistband of the garment and a belt, if one is worn, extend upward through a slot 18 into a loop 20 within the upper portion of the clip 10.

The clip 10 is preferably composed of a molded thermoplastic resin having sufficient flexibility of permit deflections allowing the edges of garments and belts of various thickness to pass through the slot 18. Preferably, the outer leg 14 includes a beveled inner surface 22, providing for the easy entry of the garment and belt into the slot 18 with gradual deflection of the clip 10. Preferably, the inner leg 12 extends downward farther than the outer leg 14, so that the inner leg 12 can be moved into a space within the belt or garment before the edge of the belt or garment is moved into contact with the inner surface 22 of the outer leg 14. Preferably, the inner leg 12 includes a bump 26, which provides an area of increased pressure to hold the clip 10 in place after it is placed over the waistband of a garment. For example, the bump 26 has a spherical radius of 4.7 mm (0.187 in.) and extends outward from the adjacent surface 27 of the inner leg 12 through a distance of 2.5 mm (0.1 in.). The clip 10 additionally includes a ridge 28 extending outward along each side 29 of the outer leg 14, with the ridges 28 being elongated in the direction of arrow 13, for engagement with a mating slot within a bottle. Each of the ridges 28 includes a lower bevel 30.

Figure 3:
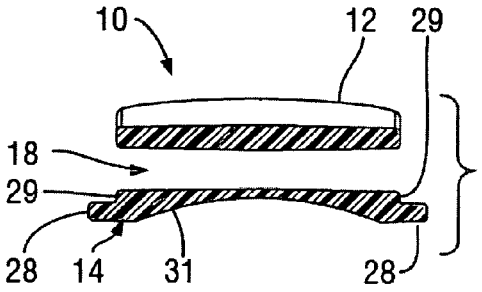
FIG. 3 is a transverse cross-sectional elevation of the clip of FIG. 1, taken as indicated by section line 3-3 therein.

Preferably, the outer leg 14 also includes a concave outer surface 31, curved to closely match the shape of a cylindrical object to be held. For example, as shown in FIG. 3, the concave outer surface 31 is curved as a portion of a cylinder having a vertical axis 31*a*, extending in the direction of arrow 13, and a radius 32 from the vertical axis of 31 mm (1.225 in.). Preferably, the concave outer surface 31 is covered with a layer 33 of a pressure-sensitive adhesive, which may be applied as a coating or as a tape attached to the concave outer surface 31.

Figure 7:
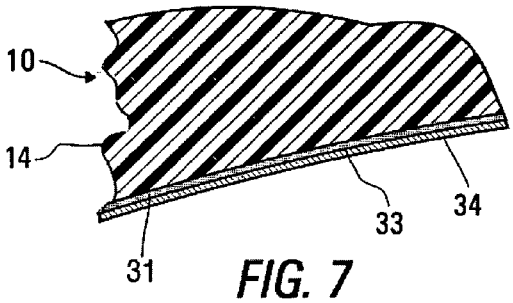
FIG. 7 is a fragmentary transverse cross-sectional elevation of the clip of FIG. 1, also taken as indicated by section line 3-3 therein.
Figure 6:
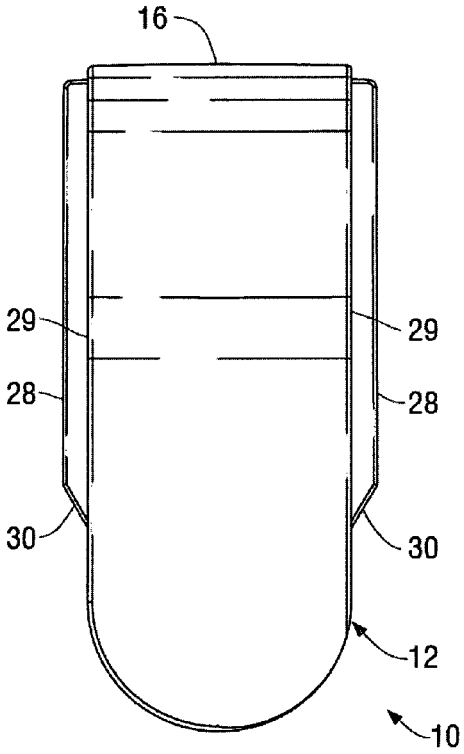
FIG. 6 is a rear elevation of the clip of FIG. 1.

FIG. 7 is a fragmentary transverse elevation of the clip 10, taken as indicated by section line 7-7 in FIG. 1 to show the concave outer surface 31 of the outer leg 14 with its pressure-sensitive adhesive layer 33. The adhesive layer 33 is preferably covered with a protective release layer 34, which protects the adhesive layer from contamination with dirt and dust. The release layer 34 does not adhere tightly to the adhesive layer 33, so the release layer 34 can be easily peeled away.

Figure 8:
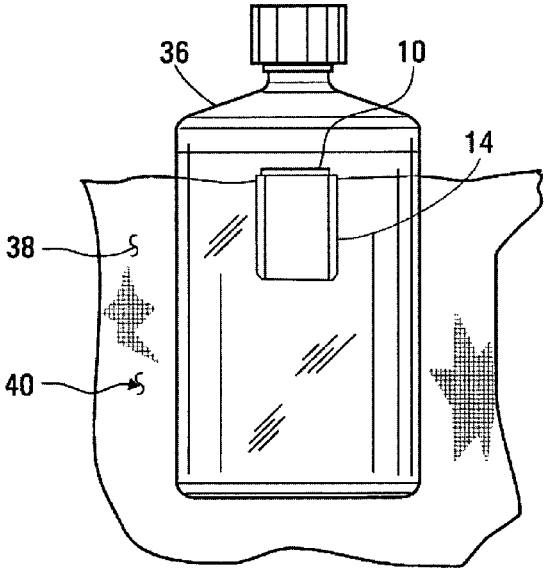
FIG. 8 is a front elevation of the clip of FIG. 1 as used to attach a water bottle to the waistband of a garment.

FIG. 8 is a front elevation of the clip 10 as used to attach a water bottle 36 to the waistband of a garment 38. The clip 10 is first prepared for attachment by peeling away the release layer 34. Then the clip 10 is pressed against the side of the bottle 10 so that the bottle 10 is attached by means of the adhesive layer 32. Next, the inner leg 12 of the clip 10 is inserted into the space under the garment 40 or under a belt, and the bottle is moved downward with the slot 18 moving downward over the waistband 38 or belt. Then, the bottle 36 is easily removed from the garment 40, with the clip 10 remaining in place on the bottle 36, and reinstalled on the garment 40, as often as necessary to consume the contents of the bottle 36.

The clip 10 is configured so that the trough formed by the concave surface 31 is open at both ends, allowing the cylindrical portion of the bottle 36 to extend past the upper and lower ends of the concave surface 31. To allow accommodation of a large variation in the thickness of inserted belts and fabric materials within the slot 18, the opening at the loop 20 must be substantially larger than the width of the slot 18. For example, the diameter of the opening of the loop 20 is 6.3 mm (0.25 in.). The greater space for this opening is accommodated by allowing the upper inner surface 42 of the inner leg 12 to extend inward, away from the outer leg 12, so that the outer leg 12 need not extend outward to interfere with the location of the bottle on the concave surface 31.

FIG. 9 is a perspective view of the clip 10, showing one of the ridges 28 extending along one of the sides 29 of the outer leg 14, along with the concave surface 31, which has been described above as being used to adhesively attach a bottle or other cylindrical object. The two ridges 31 form a first mounting structure 44 for attaching the clip 10 to bottle as described below, while the concave surface 31 forms a second mounting surface 46, for adhesively attaching the clip 10 to a bottle as described above.

Figure 4:
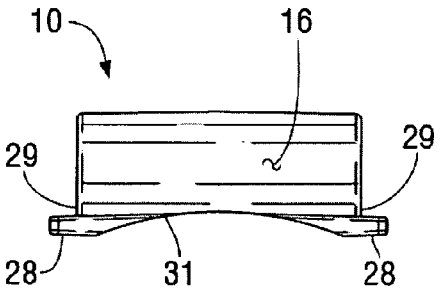
FIG. 4 is a plan view of the clip of FIG. 1.
Figure 5:
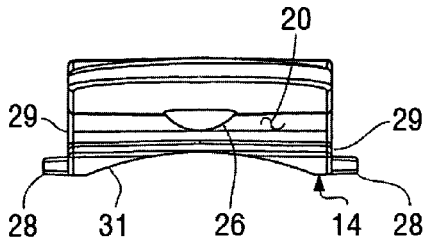
FIG. 5 is a bottom plan view of the clip of FIG. 1.

As shown in the perspective view of FIG. 10, in accordance with a second embodiment of the invention, a bottle 50 is provided with a track 52 for removably engaging the clip 10. When the clip 10 is engaged within the track 52, the inner leg 12 of the clip 10 is held in a position extending downward, in the direction of arrow 53, being spaced apart from the bottle 50, so that the clip 10 may be slid over a belt or waistband to hold the bottle 50 attached to the belt or waistband, generally as shown in FIG. 4. For example, the bottle 50 and the clip 10 are sold attached to one another, as shown in FIG. 10. After the contents of the bottle 10 are consumed, the user can slide the clip 10 downward along the bottle 10, in the direction of arrow 53, disengaging the clip 10 from the bottle 10, so that the clip 10 can be attached to another bottle using the adhesively coated concave surface 31 as described above. Alternately, the bottle 50 and the clip 10 may be sold separately.

Figure 14:
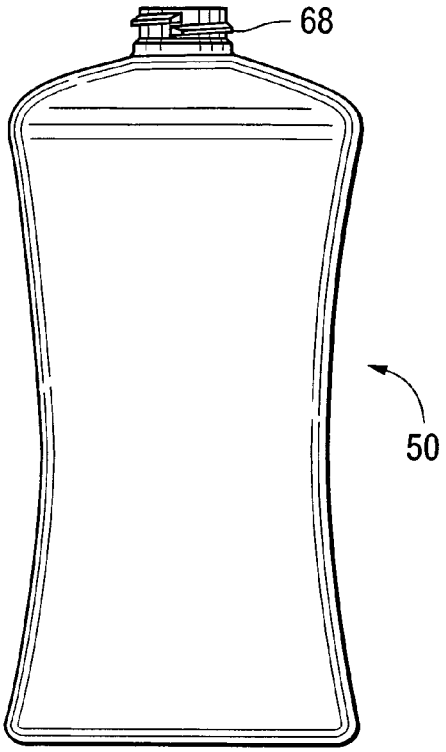
FIG. 14 is a front view of the bottle of FIG. 10.
Figure 15:
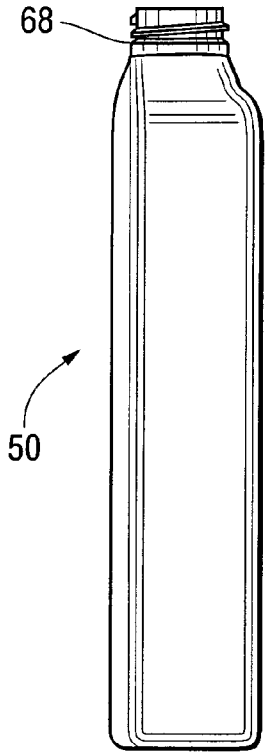
FIG. 15 is a right side view of the bottle of FIG. 10.
Figure 16:
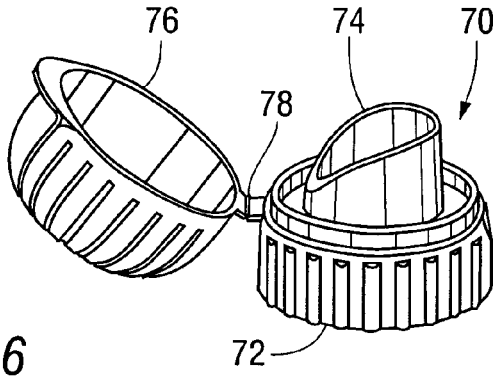
FIG. 16 is a perspective view of a cap attachable to the bottle of FIG. 10.
Figure 17:
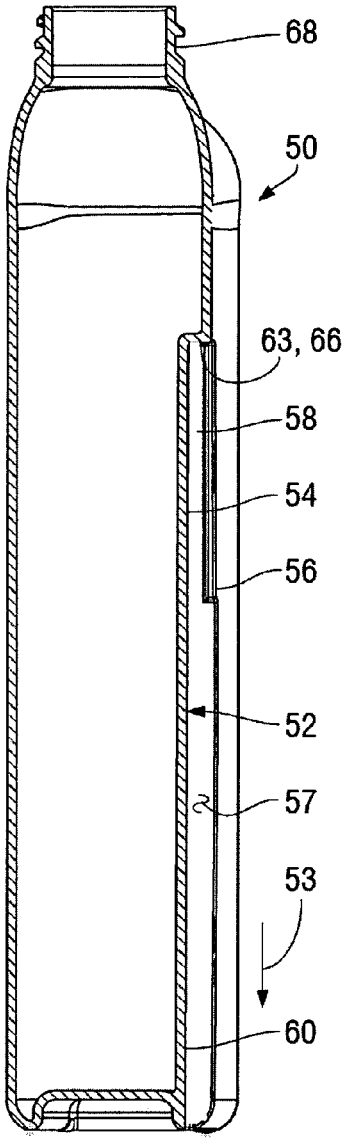
FIG. 17 is a right cross-sectional elevation of the bottle of FIG. 10, taken as indicated by section lines 17-17 in FIG. 11.
Figure 18:
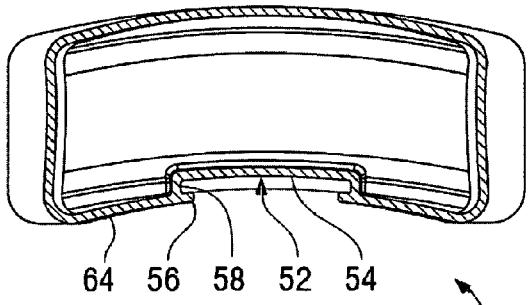
FIG. 18 is a first cross-sectional plan view of the bottle of FIG. 10, taken as indicated by section lines 18-18 in FIG. 11.
Figure 19:
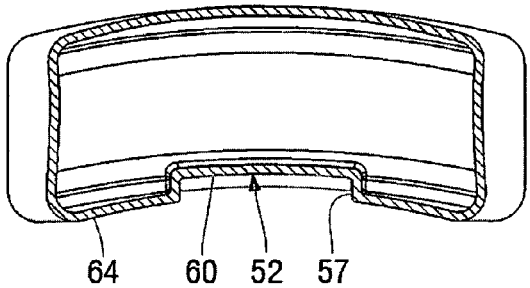
FIG. 19 is a second cross-sectional view of the bottle of FIG. 10, taken as indicated by section lines 19-19 in FIG. 11.

Various features of the bottle 50 will now be discussed in reference to FIGS. 11-19, with FIG. 11 being a rear view thereof, with FIG. 12 being a plan view thereof, with FIG. 13 being a bottom plan view thereof, with FIG. 14 being a front elevation thereof, and with FIG. 15 being right side elevation thereof. The left side elevation of the bottle 50 is a mirror image of the right side elevation. FIG. 16 is a perspective view of a cap that can be removably attached to the bottle 50. FIGS. 17, 18, and 19 are cross sectional views of the bottle 50, taken as indicated in FIG. 11 by section lines 17-17, 18-18, and 19-19, respectively.

Within the bottle 50, the track 52 includes an upper section 54 having a pair of ridges 56, extending inward from the sides 57 of the track 52 to form, underlying slots 58, into which the ridges 28 are inserted as the clip 10 is moved upward along the bottle 10, opposite the direction of arrow 53. The lower portion 60 of the track 52 is widened, not including the ridges 56 to allow free movement of the clip 10 within this portion 60. The track 52 may be tapered to be wider at a lower end 62 than at an upper end 63 to facilitate the insertion and removal of the clip 10 and to facilitate the manufacture of the bottle 50 from a plastic resin using a molding process to form the track 52 by a sliding die element (not shown) removed in the direction of arrow 53. As the clip 10 is moved into engagement with the track 52, in the upward direction, opposite the direction of arrow 53, movement is stopped by contact between an upwardly directed stopping surface 65 of the clip 10 (shown in FIG. 9) and the upper end 63, which forms a downwardly facing stopping surface of the track 52. This arrangement allows the bottle 50 to be carried in an upright position by the clip 10 without disengaging from the clip 10 due to the weight of the bottle 50. The clip 10 is then removed from the bottle 50 by first moving the clip 10 downward, in the direction of arrow 53, so that the ridges 56 are removed from the slots 58.

For example, the rear surface 64 of the bottle 50 has a concave shape allowing the bottle 10 to be placed on a shelf close to a wall with the clip 10 in place within the track 52.

Preferably, the bottle 50 includes an opening 66 for filling or draining the bottle 50, with the opening 66 being disposed within an externally threaded surface 68. As shown in FIG. 16, a cap 70, configured for attachment to the bottle 50, includes a housing 72 having an internally threaded surface (not shown) engaging the externally threaded surface 68 of the bottle 10, a spout 74, through which a liquid held within the bottle 50 is poured, and a cover 76, which is attached by a flexible hinge member 78 to be rotated into place over the spout 74.

Figure 20:
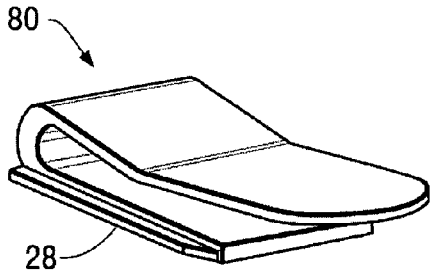
FIG. 20 is a perspective view of a clip built in accordance with a third embodiment of the invention.

FIG. 20 is a perspective view of a clip 80 made in accordance with a third embodiment of the invention to include a pair of ridges 28 for attachment to the bottle 10, but not the cylindrical surface 34 (shown in FIG. 9) for attachment to other bottles and cylindrical objects. Again, the clip 80 may be sold with the bottle 10 or separately therefrom.

While the invention has been described in its preferred embodiments with some degree of particularity, it is understood that this description has been given only by way of example, and that many variations can be made without departing from the spirit and scope of the invention, as defined in the appended claims.

What is claimed is:

1. Apparatus comprising:

a bottle having a rear surface and a track extending along the rear surface, having a downwardly directed stopping surface; and a clip having an upper portion, an inner leg and an outer leg, extending downward from opposite ends of the upper portion, an upwardly directed stopping surface and a first mounting structure, wherein the first mounting structure engages the track of the bottle as the clip is moved upward along the bottle with the first mounting structure within the track to hold the clip in place within the track, with the inner leg extending downward, being spaced apart from the outer leg and from the bottle, and with additional movement of the clip within the track being prevented by contact between the upwardly directed stopping surface and the downwardly directed stopping surface, wherein the clip additionally comprises a second mounting surface, comprising a concave cylindrical surface coated with a contact adhesive, forming a portion of an outer surface of the outer leg for adhesively attaching a different bottle.

2. The apparatus of claim 1, wherein the first mounting structure includes a ridge extending outward from each side of the inner leg of the clip, and the track is formed as a rectangular slot, including ridges extending inward from opposite sides of the rectangular slot to form adjacent slots into which the ridges of the first mounting structure are moved with the inner leg of the clip within the slot of the track to hold the clip in place within the track.

3. The apparatus of claim 1, wherein the rear surface of the bottle is concavely curved, allowing the bottle to be placed on a shelf with the rear surface close to a wall and with the clip in place within the track of the bottle.

4. The apparatus of claim 1, additionally comprising a cap attached at an upper end of the bottle, wherein the cap comprises a housing having a spout and a cover attached to the housing by a flexible hinge strip.

5. Apparatus comprising:

a first bottle having a rear surface and a track disposed at the rear surface; and a clip, removably engaging the track of the bottle, having an upper portion, a pair of spaced-apart legs extending downward from the upper portion, and a concave cylindrical surface coated with a contact adhesive, forming a portion of an outer surface of the clip for adhesively attaching a second bottle with the clip removed from the first bottle.

6. The apparatus of claim 5, wherein the rear surface of the bottle is concavely curved, allowing the bottle to be placed on a shelf with the rear surface close to a wall and with the clip in place within the track of the bottle.

* * * * *